US010359007B2

(12) United States Patent
Ito et al.

(10) Patent No.: US 10,359,007 B2
(45) Date of Patent: Jul. 23, 2019

(54) INTAKE APPARATUS FOR INTERNAL COMBUSTION ENGINE AND OUTSIDE GAS DISTRIBUTION STRUCTURE FOR INTERNAL COMBUSTION ENGINE

(71) Applicant: AISIN SEIKI KABUSHIKI KAISHA, Kariya-shi, Aichi-ken (JP)

(72) Inventors: Atsushi Ito, Anjo (JP); Keitaro Mori, Anjo (JP)

(73) Assignee: AISIN SEIKI KABUSHIKI KAISHA, Kariya-shi, Aichi-Ken (JP)

( * ) Notice: Subject to any disclaimer, the term of this patent is extended or adjusted under 35 U.S.C. 154(b) by 0 days.

(21) Appl. No.: 15/514,933

(22) PCT Filed: Oct. 30, 2015

(86) PCT No.: PCT/JP2015/080661
§ 371 (c)(1),
(2) Date: Mar. 28, 2017

(87) PCT Pub. No.: WO2016/072355
PCT Pub. Date: May 12, 2016

(65) Prior Publication Data

US 2017/0211519 A1 Jul. 27, 2017

(30) Foreign Application Priority Data

Nov. 4, 2014 (JP) ..... 2014-223923

(51) Int. Cl.
*F02M 26/00* (2016.01)
*F02M 26/17* (2016.01)
(Continued)

(52) U.S. Cl.
CPC ..... *F02M 26/00* (2016.02); *F02M 26/17* (2016.02); *F02M 35/10* (2013.01);
(Continued)

(58) Field of Classification Search
CPC ..... F02M 26/00; F02M 35/1045; F02M 35/10222; F02M 35/104; F02M 35/112;
(Continued)

(56) References Cited

U.S. PATENT DOCUMENTS 5,427,080 A 6/1995 Maeda et al.
2003/0121508 A1* 7/2003 Klas ..... F02B 75/22 123/568.17
2006/0191505 A1 8/2006 Doko et al.

FOREIGN PATENT DOCUMENTS

JP S63-177653 U 11/1988
JP H1-095563 U 6/1989
(Continued)

OTHER PUBLICATIONS

Office Action (Notification of Reasons for Refusal) dated Jan. 9, 2018, by the Japanese Patent Office in corresponding Japanese Patent Application No. 2014-223923, and an English Translation of the Office Action. (6 pages).
(Continued)

*Primary Examiner* — Jacob M Amick
*Assistant Examiner* — Charles Brauch
(74) *Attorney, Agent, or Firm* — Buchanan Ingersoll & Rooney PC

(57) ABSTRACT

An intake apparatus for an internal combustion engine includes an intake apparatus body including a plurality of intake pipes which are connected to respective cylinders of the internal combustion engine, the internal combustion engine including the cylinders of which the number is multiples of three, and an outside gas distribution portion distributing outside gas to each of the plurality of intake pipes, the outside gas distribution portion including a single first outside gas distribution pipe connected to an outside gas supply source, a plurality of second outside gas distribution pipes branched from the first outside gas distribution por-
(Continued)

tion, an outside gas collective passage gathering outside gas from the plurality of second outside gas distribution pipes, and three third outside gas distribution pipes branched from the outside gas collective passage and connected to the plurality of intake pipes respectively.

8 Claims, 5 Drawing Sheets

(51) Int. Cl.
*F02M 35/10* (2006.01)
*F02M 35/104* (2006.01)
*F02M 35/112* (2006.01)

(52) U.S. Cl.
CPC ..... *F02M 35/104* (2013.01); *F02M 35/1045* (2013.01); *F02M 35/10222* (2013.01); *F02M 35/112* (2013.01); *F02M 35/1036* (2013.01); *F02M 35/10321* (2013.01)

(58) Field of Classification Search
CPC .... F02M 35/10; F02M 26/17; F02M 35/1036; F02M 35/10321
See application file for complete search history.

(56) References Cited

FOREIGN PATENT DOCUMENTS

| | | | | |
|---|---|---|---|---|
| JP | H06-010776 | A | | 1/1994 |
| JP | H11-351070 | A | | 12/1999 |
| JP | 2000-008968 | A | | 1/2000 |
| JP | 2011-080396 | A | | 4/2011 |
| JP | 2014-040801 | A | | 3/2014 |
| KR | 20060132187 | A | * | 12/2006 |
| KR | 20060132187 | A | * | 12/2006 |

OTHER PUBLICATIONS

International Search Report (PCT/ISA/210) dated Jan. 12, 2016, by the Japanese Patent Office as the International Searching Authority for International Application No. PCT/JP2015/080661.
Written Opinion (PCT/ISA/237) dated Jan. 12, 2016, by the Japanese Patent Office as the International Searching Authority for International Application No. PCT/JP2015/080661.

* cited by examiner

INTAKE APPARATUS FOR INTERNAL COMBUSTION ENGINE AND OUTSIDE GAS DISTRIBUTION STRUCTURE FOR INTERNAL COMBUSTION ENGINE

TECHNICAL FIELD

The present invention relates to an intake apparatus for an internal combustion engine and an outside gas distribution structure for an internal combustion engine. More particularly, the present invention relates to an intake apparatus for an internal combustion engine and an outside gas distribution structure for an internal combustion engine, which are configured to be connected to an internal combustion engine that includes cylinders of which the number is multiples of three.

BACKGROUND ART

An intake apparatus for an internal combustion engine, which is configured to be connected to an internal combustion engine including cylinders of which the number is multiples of three, for example, has been known. Such intake apparatus for the internal combustion engine is disclosed in JP2000-8968A, for example.

JP2000-8968A discloses an exhaust gas recirculation apparatus for an internal combustion engine where an intake manifold made of resin is connected to an in-line three-cylinder internal combustion engine. In the exhaust gas recirculation apparatus for the internal combustion engine disclosed in JP2000-8968A, the intake manifold is connected to a cylinder head via a spacer member and a gasket. An exhaust gas recirculation passage is provided at an inner portion of the spacer member and the gasket which overlap each other so that a portion of exhaust gas (EGR gas) is introduced to an inlet port. The exhaust gas recirculation passage through which the EGR gas flows is configured so that, from an upstream side to a downstream side, a single EGR gas inlet passage is connected to a single collective chamber (chamber) of which an inner volume is expanded and three EGR gas branch passages are branched from the collective chamber. Each of the three EGR gas branch passages is configured to be connected to the inlet port of each of three cylinders of the cylinder head.

DOCUMENT OF PRIOR ART

Patent Document

Patent document 1: 2000-8968A

OVERVIEW OF INVENTION

Problem to be Solved by Invention

According to the exhaust gas recirculation apparatus for the internal combustion engine disclosed in JP2000-8968A, the single EGR gas inlet passage is configured to be branched into the three EGR gas branch passages via the single collective chamber. Thus, it is considered to be difficult that the EGR gas (outside gas) is uniformly distributed to the inlet ports of the three cylinders. That is, in a case where a positional relation between an outlet of the single EGR gas inlet passage relative to the collective chamber and an inlet of each of the three EGR gas branch passages relative to the collective chamber is not appropriate, the EGR gas flowing through the collective chamber may be biased to flow to the specific EGR gas branch passage. At this time, according to an intake apparatus mounted to an internal combustion engine including cylinders of which the number is not multiples of three, i.e., two cylinders, four cylinders or eight cylinders, for example, an outside gas distribution portion is configured in a tournament style where branching of one passage into two passages is repeated so that distribution accuracy of EGR gas relative to intake pipes may be maintained at a high level. On the other hand, in an intake apparatus for an internal combustion engine including cylinders of which the number is multiples of three, the construction as disclosed in the aforementioned patent document that the single EGR gas inlet passage is branched into three via the collective chamber is only obtainable. As a result, an issue that high distribution accuracy of outside gas (EGR gas) which is achieved in the known tournament style may not be secured is raised.

The present invention is obtained to solve the aforementioned drawbacks and includes an object to provide an intake apparatus for an internal combustion engine and an outside gas distribution structure for an internal combustion engine, which may secure high distribution accuracy of outside gas supplied to cylinders of the internal combustion engine including the cylinders of which the number is multiples of three.

Means for Solving Problem

In order to accomplish the aforementioned object, according to a first aspect of the present invention, an intake apparatus for an internal combustion engine includes an intake apparatus body including a plurality of intake pipes which are connected to respective cylinders of the internal combustion engine, the internal combustion engine including the cylinders of which the number is multiples of three, and an outside gas distribution portion distributing outside gas to each of the plurality of intake pipes, the outside gas distribution portion including a single first outside gas distribution pipe connected to an outside gas supply source, a plurality of second outside gas distribution pipes branched from the first outside gas distribution portion, an outside gas collective passage gathering outside gas from the plurality of second outside gas distribution pipes, and three third outside gas distribution pipes branched from the outside gas collective passage and connected to the plurality of intake pipes respectively.

According to the intake apparatus for the internal combustion engine in the first aspect of the present invention, as mentioned above, the outside gas distribution portion is configured to include the plural second outside gas distribution pipes branched from the single first outside gas distribution pipe, the outside gas collective passage which gathers the outside gas from the plural second outside gas distribution pipes and the three third outside gas distribution pipes branched from the outside gas collective passage so as to be connected to the respective intake pipes. Accordingly, the first outside gas distribution pipe is branched into the plural second outside gas distribution pipes and is thereafter once gathered at the outside gas collective passage so as to be connected to the third outside gas distribution pipes. Thus, the outside gas may be equally and uniformly dispersed within the outside gas collective passage (an outside gas concentration within the outside gas collective passage is equalized) by appropriate adjustment of positions of the outlets of the second outside gas distribution pipes relative to the outside gas collective passage and positions of the inlets of the third outside gas distribution pipes relative to the outside gas collective passage. Accordingly, the outside gas of which gas concentration is uniform within the outside gas collective passage is equally distributed (by one-third each) to the three third outside gas distribution pipes branched from the outside gas collective passage. Because the entire outside gas distribution portion may be configured so that the outside gas is uniformly and equally distributable from the single first outside gas distribution pipe to ultimately the three third outside gas distribution pipes, distribution accuracy of the outside gas supplied to each of the cylinders of the internal combustion engine including the cylinders of which the number is multiples of three may be maintained at a high level.

The outside gas includes water (water vapor) discharged along with combustion of air-fuel mixture. The outside gas is influenced by an outside air temperature and is cooled while the outside gas is flowing through the first outside gas distribution pipe and the plural second outside gas distribution pipes brunched from the first outside gas distribution pipe. In the present invention, even in a case where the water vapor is cooled to become condensed water along with cooling of the outside gas, the outside gas is equally distributed (by one-third each) to the three third outside gas distribution pipes. Thus, the condensed water may be restrained from being biased to flow to any specific outside gas distribution pipe among the three third outside gas distribution pipes. Because the condensed water may be also equally distributed to the third outside gas distribution pipes, occurrence of misfire of a cylinder caused by intensive flow of the condensed water to the specific cylinder may be restrained. The present invention includes high usefulness accordingly.

In the intake apparatus for the internal combustion engine in the aforementioned first aspect, favorably, the plurality of second outside gas distribution pipes includes two second outside gas distribution pipes, and an outlet of each of the second outside gas distribution pipes relative to the outside gas collective passage is arranged between two inlets of the third outside gas distribution pipes relative to the outside gas collective passage, the two inlets being next to each other. According to the aforementioned construction, because the outlet of one of the two second outside gas distribution pipes relative to the outside gas collective passage is arranged between the inlets of the third outside gas distribution pipes next to each other among the three third outside gas distribution pipes, the outside gas may be uniformly and equally dispersed within the outside gas collective passage. That is, the outside gas concentration within the outside gas collective passage is uniform to thereby equally distribute the outside gas within the outside gas collective passage to the three branched third outside gas distribution pipes.

In the construction where the two second outside gas distribution pipes are provided, favorably, in the outside gas collective passage, a minimum flow passage cross-sectional area between the outlet of each of the second outside gas distribution pipes relative to the outside gas collective passage and an inlet positioned at an inner side than the outlet among three inlets of the third outside gas distribution pipes relative to the outside gas collective passage is smaller than a minimum flow passage cross-sectional area between the outlet and the inlet positioned at an outer side than the outlet among the three inlets. Accordingly, a flow passage resistance from the outlet of each of the second outside gas distribution pipes for the outside gas collective passage to the inlet positioned at the inner side than the outlet among the three inlets of the third outside gas distribution pipes for the outside gas collective passage may be greater than a flow passage resistance from the outlet of each of the second outside gas distribution pipes for the outside gas collective passage to the inlet positioned at the outer side than the outlet among the three inlets of the third outside gas distribution pipes for the outside gas collective passage. Thus, a flow rate of the outside gas flowing to the inlet positioned at a center among the three inlets of the third outside gas distribution pipes for the outside gas collective passage (the inlet of the third outside gas distribution pipe positioned at the inner side than the outlet of one of the second outside gas distribution pipes), the outside gas flowing from one of the second outside gas distribution pipes to the outside gas collective passage, may be relatively smaller than a flow rate of the outside gas flowing to the inlet positioned at the outer side (the inlet of the third outside gas distribution pipe positioned at the outer side than the outlet of one of the second outside gas distribution pipes). The flow rate (total flow rate) of the gas flowing to the inlet of the second outside gas distribution pipe positioned at the center as viewed from the two second outside gas distribution pipes may come closer to a state being equal to the flow rate of the gas flowing to the inlet of the third outside gas distribution pipe positioned at each outer side as viewed from the two second outside gas distribution pipes. As a result, the outside gas within the outside gas collective passage may be securely and equally distributable to the three branched third outside gas distribution pipes.

In the intake apparatus for the internal combustion engine in the aforementioned first aspect, favorably, a protruding portion is provided at a portion of an inner bottom surface of the outside gas collective passage in a gravitational direction at a connection portion of the outside gas collective passage relative to each of the second outside gas distribution pipes, the protruding portion protruding towards the outlet of each of the second outside gas distribution pipes relative to the outside gas collective passage and distributing outside gas which is introduced from the outlet to an outer side and an inner side than the outlet. In addition, each of the inlets of the third outside gas distribution pipes relative to the outside gas collective passage is arranged at an undermost portion in the inner bottom surface of the outside gas collective passage. Accordingly, even in a case where the water vapor is cooled to become the condensed water while the outside gas flows through the first outside gas distribution pipe and the second outside gas distribution pipes, the condensed water which flows down by the protruding portion may be easily led to the inlets of the three third outside gas distribution pipes from the outside gas collective passage. Because the inlets of the three third outside gas distribution pipes are arranged in the vicinity of the undermost portions in the inner bottom surface of the outside gas collective passage, the condensed water is securely discharged to the third outside gas distribution pipes via the inlets arranged in the vicinity of the undermost portions. The condensed water is inhibited from being greatly accumulated at the outside gas collective passage.

In the intake apparatus for the internal combustion engine in the aforementioned first aspect, favorably, the outside gas is exhaust recirculation gas for recirculating a portion of exhaust gas emitted from the internal combustion engine. Accordingly, because the distribution accuracy of the exhaust recirculation gas (EGR gas) supplied to each of the cylinders of the internal combustion engine including the cylinders of which the number is multiples of three may be maintained at a high level, fuel consumption may easily increase with decrease of pumping loss (intake and exhaust loss) in the internal combustion engine including the cylinders of which the number is multiples of three. In addition, because the condensed water in addition to the exhaust recirculation gas is equally distributed to the cylinders, occurrence of misfire of a cylinder is restrained, which may easily inhibit decrease in quality of the engine.

In the intake apparatus for the internal combustion engine in the aforementioned first aspect, favorably, the plurality of second outside gas distribution pipes are connected to a wall portion at one side of the outside gas collective passage which extends along a line of the cylinders of the internal combustion engine, and the three third outside gas distribution pipes are connected to a wall portion at the other side of the outside gas collective passage which extends along the line of the cylinders of the internal combustion engine. Accordingly, the second outside gas distribution pipes and the third outside gas distribution pipes are arranged at opposite sides from each other relative to the outside gas collective passage. As a result, the outside gas distribution portion where the outside gas is easily supplied to the outside gas collective passage and is easily redistributed to the third outside gas distribution pipes from within the outside gas collective passage (the flow of the outside gas is easily controlled) is obtainable.

In the intake apparatus for the internal combustion engine in the aforementioned first aspect, favorably, the outside gas distribution portion is integrally provided at the intake apparatus body. Accordingly, weight saving of the intake apparatus body because of the outside gas distribution portion integrally provided at the intake apparatus body may be achieved.

In the intake apparatus for the internal combustion engine in the aforementioned first aspect, favorably, the outside gas distribution portion is obtained by a plurality of divided resin members which are joined to one another. Accordingly, by joining the plural divided resin members to each other, the outside gas distribution portion including a complex flow structure that includes the single first outside gas distribution pipe, the plural second outside gas distribution pipes branched from the first outside gas distribution pipe, the outside gas collective passage which gathers the outside gas from the plural second outside gas distribution pipes and the three third outside gas distribution pipes branched from the outside gas collective passage may be easily manufactured.

According to a second aspect of the present invention, an outside gas distribution structure for an internal combustion engine includes an outside gas distribution portion distributing outside gas to each of a plurality of intake pipes of an intake apparatus body, the plurality of intake pipes being connected to respective cylinders of the internal combustion engine, the internal combustion engine including the cylinders of which the number is multiples of three, the outside gas distribution portion including a single first outside gas distribution pipe connected to an outside gas supply source, a plurality of second outside gas distribution pipes branched from the first outside gas distribution portion, an outside gas collective passage gathering outside gas from the plurality of second outside gas distribution pipes and three third outside gas distribution pipes branched from the outside gas collective passage and connected to the plurality of intake pipes respectively.

According to the outside gas distribution structure for the internal combustion engine in the second aspect of the present invention, as mentioned above, the outside gas distribution portion is configured to include the plural second outside gas distribution pipes branched from the single first outside gas distribution pipe, the outside gas collective passage which gathers the outside gas from the plural second outside gas distribution pipes, and the three third outside gas distribution pipes branched from the outside gas collective passage so as to be connected to the respective intake pipes. Accordingly, the first outside gas distribution pipe is branched into the plural second outside gas distribution pipes and is thereafter once gathered at the outside gas collective passage so as to be connected to the third outside gas distribution pipes. Thus, the outside gas may be equally and uniformly dispersed within the outside gas collective passage (the outside gas concentration within the outside gas collective passage is equalized) by appropriate adjustment of the positions of the outlets of the second outside gas distribution pipes relative to the outside gas collective passage and the positions of the inlets of the third outside gas distribution pipes relative to the outside gas collective passage. Accordingly, the outside gas of which gas concentration is uniform within the outside gas collective passage is equally distributed (by one-third each) to the three third outside gas distribution pipes branched from the outside gas collective passage. Because the entire outside gas distribution portion may be configured so that the outside gas is uniformly and equally distributable from the single first outside gas distribution pipe to ultimately the three third outside gas distribution pipes, distribution accuracy of the outside gas supplied to each of the cylinders of the internal combustion engine including the cylinders of which the number is multiples of three may be maintained at a high level.

MODE FOR CARRYING OUT THE INVENTION

Embodiments of the present invention are explained with reference to the attached drawings.

First Embodiment

An intake apparatus 100 according to a first embodiment of the present invention is explained with reference to FIGS. 1 to 3. In the following, an explanation is made on a basis of an in-line three-cylinder engine 110 where cylinders are arranged along an axis X. A direction orthogonal to the axis X within a horizontal plane is referred to as an axis Y direction and an up-down direction is referred to as an axis Z direction. The in-line three-cylinder engine 110 is as an example of an "internal combustion engine" of the invention. The axis Z direction (up-down direction) is an example of a "gravitational direction" of the invention.

Figure 1:
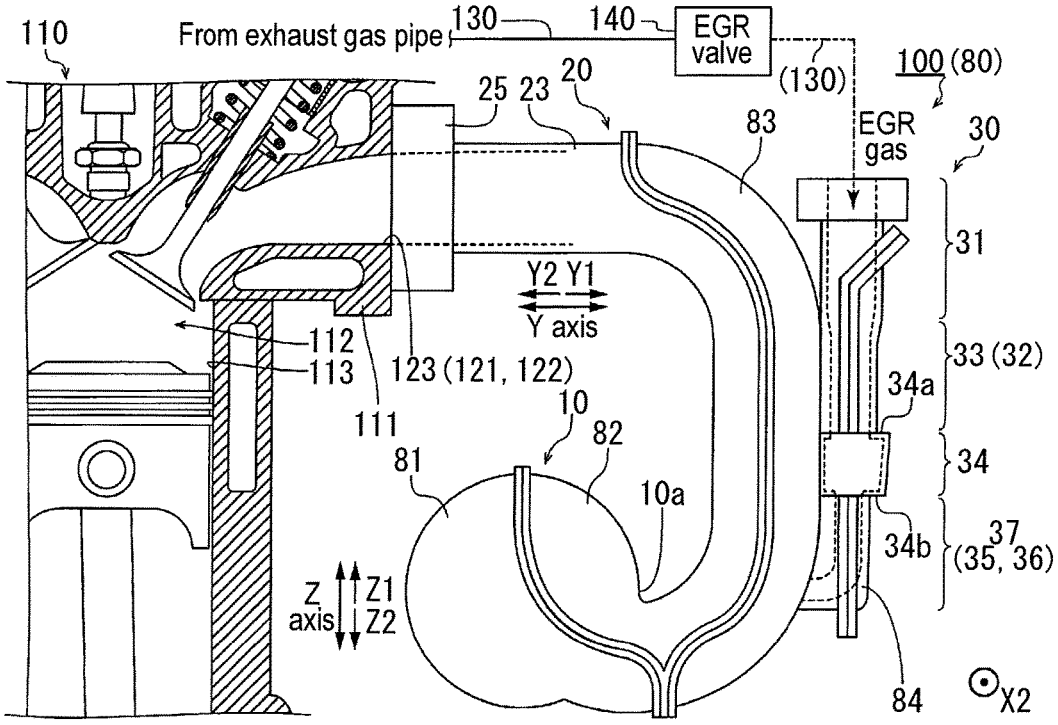
FIG. 1 is a side view of an intake apparatus according to a first embodiment of the present invention as viewed along a line of cylinders of an in-line three-cylinder engine.

As illustrated in FIG. 1, the intake apparatus 100 according to the first embodiment of the present invention is mounted at the in-line three-cylinder engine 110 (hereinafter referred to as an engine 110) serving as a gasoline engine. The three cylinders included in the engine 110 are arranged as a first cylinder, a second cylinder and a third cylinder in the mentioned order from a rear side to a front side of a paper on which FIG. 1 is drawn. The intake apparatus 100 constitutes a portion of an intake system which supplies air to the engine 110. The intake apparatus 100 includes an intake apparatus body 80 constituted by a surge tank 10 and an intake pipe portion 20 which is arranged at a downstream of the surge tank 10. In the intake apparatus 100, intake air flows to the surge tank 10 via an air cleaner (not illustrated) serving as an intake passage and a throttle valve 120 (see FIG. 2).

The surge tank 10 and the intake pipe portion 20 are both made of resin (polyamide resin). The intake apparatus body 80 is integrated by a first piece 81, a second piece 82 and a third piece 83 each of which is made of resin and which are joined to each other by vibration welding. The first piece 81 constitutes substantially a half of the surge tank 10. The second piece 82 constitutes substantially a remaining half of the surge tank 10 and substantially a half of the intake pipe portion 20 connected to the surge tank 10. The third piece 83 constitutes substantially a half of the intake pipe portion 20 and substantially a half of an EGR gas distribution portion 30 which is explained later.

The intake pipe portion 20 functions to distribute the intake air stored at the surge tank 10 to each of the cylinders within a cylinder head 111. A direction of an arrow Z2 at the intake pipe portion 20 corresponds to an intake upstream side connected to the surge tank 10. A direction of an arrow Z1 at the intake pipe portion 20 corresponds to an intake downstream side connected to the engine 110 (cylinder head 111).

The engine 110 is configured so that EGR (Exhaust Gas Recirculation) gas serving as a portion of exhaust gas which is emitted from a combustion chamber 112 (cylinder 113) recirculates through the intake apparatus 100. The EGR gas separated from the exhaust gas is cooled down to approximately around 100° C. and thereafter is introduced to the intake apparatus body 80. An EGR gas pipe 130 branched from an exhaust gas pipe (not illustrated) of the engine 110 is connected to the EGR gas distribution portion 30. An EGR valve 140 is provided at a portion of the EGR gas pipe 130 for controlling recirculation rate (EGR rate). The EGR gas includes water (water vapor). The EGR gas is as an example of "outside gas" and "exhaust recirculation gas" of the invention. Each of the exhaust gas pipe of the engine 110 and the EGR gas pipe 130 is as an example of an "outside gas supply source" of the invention.

Figure 2:
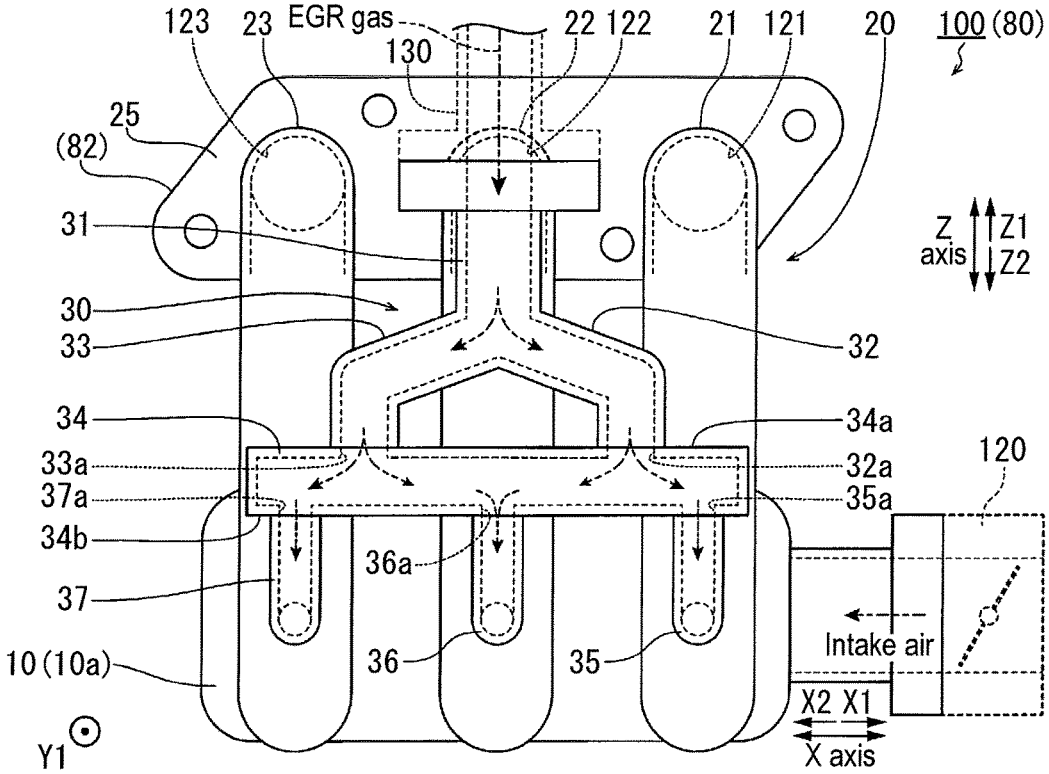
FIG. 2 is a diagram of the intake apparatus according to the first embodiment of the present invention as viewed from a lateral side of the in-line three-cylinder engine.

As illustrated in FIG. 2, the surge tank 10 is provided to extend along a line of cylinders (X axis) of the engine 110 (see FIG. 1). The intake pipe portion 20 is constituted by an intake pipe 21, an intake pipe 22 and an intake pipe 23 in the mentioned order from an X1 side. That is, the intake pipes 21 to 23 are arranged along the line of cylinders. One ends (Z2 side) of the intake pipes 21 to 23 are connected to a side portion 10*a* of the surge tank 10. The other ends (Z1 side) of the intake pipes 21 to 23 are connected to a first intake port 121 for the first cylinder (at the most X1 side) of the engine 110, a second intake port 122 for the second cylinder (at a middle position) of the engine 110 and a third intake port 123 for the third cylinder (at the most X2 side) of the engine 110 via a common flange portion 25. The flange portion 25 is provided integrally at the second piece 82. In FIG. 2, the illustration of the engine 110 positioned at the rear side of the paper on which FIG. 2 is drawn relative to the intake apparatus body 80 is omitted for convenience.

According to the first embodiment, as illustrated in FIGS. 1 and 2, the EGR gas distribution portion 30 is provided at an outer side portion of the intake apparatus body 80 at Y1 side. The EGR gas distribution portion 30 functions to distribute the EGR gas which is recirculated to the engine 110 to the intake pipes 21 to 23 for the respective cylinders. The EGR gas distribution portion 30 is integrated with the intake apparatus body 80 in a state where a fourth piece 84 (see FIG. 1) made of resin is joined by vibration welding from the Y1 side to the third piece 83 (see FIG. 1) arranged at Y2 side so that the intake apparatus body 80 may be light-weighted. The EGR gas distribution portion 30 is an example of an "outside gas distribution portion" of the invention. Hereinafter, a detailed construction and a function of the EGR gas distribution portion 30 are explained.

As illustrated in FIG. 2, the EGR gas distribution portion 30 includes a single upstream main pipe 31, two upstream branch pipes 32 and 33 branched from the upstream main pipe 31, a collective pipe 34, and three downstream distribution pipes 35, 36 and 37 branched from the collective pipe 34. The upstream main pipe 31 is connected to a downstream side of the EGR valve 140 (see FIG. 1). The EGR gas from the upstream branch pipe 32 and the EGR gas from the upstream branch pipe 33 are again gathered at the collective pipe 34. The downstream distribution pipes 35, 36 and 37 are connected to the intake pipes 21, 22 and 23, respectively. In FIG. 2, a condition of an inner wall portion (internal flow passage) in the EGR gas distribution portion 30 is illustrated by broken lines. The upstream main pipe 31 is as an example of a "first outside gas distribution pipe" of the invention. Each of the upstream branch pipes 32 and 33 is as an example of a "second outside gas distribution pipe" of the invention. The collective pipe 34 is as an example of an "outside gas collective passage" of the invention. Each of the downstream distribution pipes 35 to 37 is as an example of a "third outside gas distribution pipe" of the invention.

According to the first embodiment, the EGR gas distribution portion 30 is configured so that the single upstream main pipe 31 is branched into the upstream branch pipes 32 and 33 which are once gathered at the collective pipe 34 and thereafter branched from the collective pipe 34 into the three downstream distribution pipes 35 to 37. The aforementioned EGR gas distribution structure of the EGR gas distribution portion 30 is as an example of an "outside gas distribution structure for an internal combustion engine" of the invention.

As illustrated in FIG. 1, the EGR gas distribution portion 30 is arranged so that a portion from the upstream main pipe 31 to a middle point of each of the downstream distribution pipes 35 to 37 through the collective pipe 34 linearly extends along the axis Z. The middle point of each of the downstream distribution pipes 35 to 37 (see FIG. 2) is configured to gradually change its direction to an arrow Y2 direction so as to be connected to a side wall portion of each of the intake pipes 21 to 23 (see FIG. 2) at the Y1 side.

In a state where the intake apparatus body 80 is mounted to the engine 110, the collective pipe 34 extends along the line of cylinders (X axis) and extends in a straight pipe form along a horizontal direction as illustrated in FIG. 2. Therefore, the collective pipe 34 includes opposed end portions (at the X1 side and the X2 side) and a center portion area. The upstream branch pipes 32 and 33 are connected, in a row along the line of cylinders, to a side wall portion 34*a* of the collective pipe 34 at the Z1 side (upper side) in a longitudinal direction (axis X direction) of the collective pipe 34. In addition, the downstream distribution pipes 35 to 37 are connected, in a row along the line of cylinders, to a side wall portion 34*b* of the collective pipe 34 at the Z2 side (lower side) in the longitudinal direction (axis X direction) of the collective pipe 34.

Figure 3:
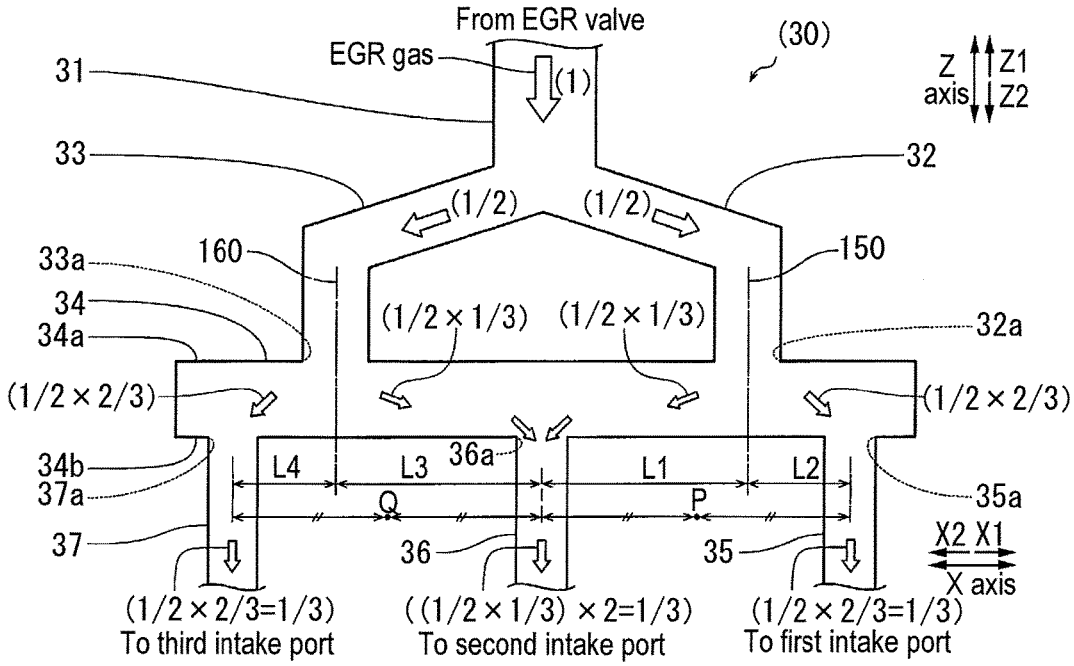
FIG. 3 is a schematic view of a flow passage construction of an EGR gas distribution portion provided at the intake apparatus according to the first embodiment of the present invention.

Specifically, an outlet 32*a* of the upstream branch pipe 32 (at the X1 side) relative to the collective pipe 34 and an outlet 33*a* of the upstream branch pipe 33 (at the X2 side) relative to the collective pipe 34 are provided at the side wall portion 34*a* in a state where the outlet 32*a* and the outlet 33*a* are spaced away from each other by a predetermined interval (=L1+L3, see FIG. 3). In addition, an inlet 35*a* of the downstream distribution pipe 35 (at the most X1 side) relative to the collective pipe 34 and an inlet 36*a* of the downstream distribution pipe 36 (at a center position) relative to the collective pipe 34 are provided at the side wall portion 34*b* in a state where the inlet 35*a* and the inlet 36*a* are spaced away from each other by a predetermined interval (=L1+L2, see FIG. 3). Further, an inlet 37*a* of the downstream distribution pipe 37 (at the most X2 side) relative to the collective pipe 34 and the inlet 36*a* are provided at the side wall portion 34*b* in a state where the inlet 37*a* and the inlet 36*a* are spaced away from each other by a predetermined interval (=L3+L4, see FIG. 3).

In the first embodiment, the outlet 32*a* of the upstream branch pipe 32 relative to the collective pipe 34 is arranged between the inlet 35*a* of the downstream distribution pipe 35 relative to the collective pipe 34 and the inlet 36*a* of the downstream distribution pipe 36 relative to the collective pipe 34. In the similar manner, the outlet 33*a* of the upstream branch pipe 33 relative to the collective pipe 34 is arranged between the inlet 37*a* of the downstream distribution pipe 37 relative to the collective pipe 34 and the inlet 36*a* of the downstream distribution pipe 36 relative to the collective pipe 34.

In this case, as illustrated in FIG. 3, a center of the outlet 32*a* is arranged at a position (a position of an alternate long and short dash line 150) closer to the inlet 35*a* side serving as an outer side (at the X1 side) relative to a center position P between the inlet 35*a* and the inlet 36*a*. In the similar manner, a center of the outlet 33*a* is arranged at a position (a position of an alternate long and short dash line 160) closer to the inlet 37*a* side serving as an outer side (at the X2 side) relative to a center position Q between the inlet 37*a* and the inlet 36*a*. That is, a horizontal distance L2 from the outlet 32*a* to the inlet 35*a* is smaller than a horizontal distance L1 from the outlet 32*a* to the inlet 36*a* (L2<L1). At this time, a positional relation of each of the inlets 35*a* and 36*a* in the horizontal direction relative to the outlet 32*a* is adjusted so that L1:L2=2:1 is achieved. In the similar manner, the horizontal distance L4 from the outlet 33*a* to the inlet 37*a* is smaller than the horizontal distance L3 from the outlet 33*a* to the inlet 36*a* (L4<L3). At this time, a positional relation of each of the inlets 37*a* and 36*a* in the horizontal direction relative to the outlet 33*a* is adjusted so that L3:L4=2:1 is achieved. In the collective pipe 34, L1=L3 and L2=L4 are specified so that the upstream branch pipes 32 and 33 branched from the upstream main pipe 31 exhibit a symmetrical configuration along the axis X.

Accordingly, the distribution (flow state) of the EGR gas is adjusted as follows. First, the single upstream main pipe 31 is branched into the upstream branch pipes 32 and 33 so that a half of flow rate of the EGR gas at the upstream main pipe 31 flows to each of the upstream branch pipes 32 and 33. The EGR gas is supplied to the collective pipe 34 from the outlets 32*a* and 33*a* at equal gas flow rates to each other. That is, the single upstream main pipe 31 is branched into the two upstream branch pipes 32 and 33 which are thereafter connected to the collective pipe 34 so that the EGR gas is supplied to the collective pipe 34 in a state where EGR gas concentration within the collective pipe 34 may be uniform as much as possible. Because the EGR gas concentration within the collective pipe 34 is uniform, the EGR gas is evenly suctioned to any of the downstream distribution pipes 35 to 37 at the downstream side.

Two thirds of a half (=½×⅔) of the EGR gas flows to the downstream distribution pipe 35 from the upstream branch pipe 32 because of L2<L1 which results in a small flow passage resistance. In addition, one third of a half (=½×⅔) of the EGR gas flows to the downstream distribution pipe 36 from the upstream branch pipe 32. In the similar manner, two thirds of a half (=½×⅔) of the EGR gas flows to the downstream distribution pipe 37 from the upstream branch pipe 33 because of L2<L1 which results in a small flow passage resistance. In addition, one third of a half (=½×⅔) of the EGR gas flows to the downstream distribution pipe 36 from the upstream branch pipe 33.

Accordingly, one third of the EGR gas at the upstream main pipe 31 flows to the downstream distribution pipe 35 while one third of the EGR gas at the upstream main pipe 31 also flows to the downstream distribution pipe 37. In addition, one third (=2×(½×⅔)) of the EGR gas at the upstream main pipe 31, which is obtained by a sum of the gas flow rate from the upstream branch pipe 32 (one third of a half) and the gas flow rate from the upstream branch pipe 33 (one third of a half), flows to the downstream distribution pipe 36. As a result, the outside gas distribution portion 30 is configured so that one-third of flow rate of the EGR gas flowing through the upstream main pipe 31 is equally distributed to each of the downstream distribution pipes 35 to 37 in a state where the EGR gas concentration within the collective pipe 34 is equalized because the upstream branch pipes 32, 33 and the collective pipe 34 are disposed between the upstream main pipe 31 and the downstream distribution pipes 35 to 37.

In addition, as illustrated in FIG. 1, the intake pipes 21 to 23 constituting the intake pipe portion 20 are connected in parallel to the surge tank 10. In the intake apparatus 100, the intake air reaches the surge tank 10 via the air cleaner (not illustrated) serving as the intake passage and the throttle valve 120 to flow to the surge tank 10. The intake apparatus 100 of the in-line three-cylinder engine 110 according to the first embodiment is constructed in the aforementioned manner.

Effects of the First Embodiment

The first embodiment achieves the following effects.

In the first embodiment, as mentioned above, the outside gas distribution portion 30 is configured to include the plural (two) upstream branch pipes 32 and 33 branched from the single upstream main pipe 31, the collective pipe 34 which gathers the EGR gas from the plural (two) upstream branch pipes 32 and 33, and the three downstream distribution pipes 35 to 37 branched from the collective pipe 34 so as to be connected to the intake pipes 21 to 23 respectively. Accordingly, the upstream main pipe 31 is branched into the plural (two) upstream branch pipes 32 and 33 and is thereafter once gathered at the collective pipe 34 so as to be connected to the downstream distribution pipes 35 to 37. Thus, the EGR gas may be equally and uniformly dispersed within the collective pipe 34 (the EGR gas concentration within the collective pipe 34 is equalized) by appropriate adjustment of the positions of the outlets 32*a* and 33*a* of the upstream branch pipes 32 and 33 relative to the collective pipe 34 and the positions of the inlets 35*a* to 37*a* of the downstream distribution pipes 35 to 37 relative to the collective pipe 34. Accordingly, the EGR gas of which the gas concentration is uniform within the collective pipe 34 is equally distributed (by one-third each) to the three branched downstream distribution pipes 35 to 37. Because the entire outside gas distribution portion 30 may be configured so that the EGR gas is uniformly and equally distributable from the single upstream main pipe 31 to ultimately the three downstream distribution pipes 35 to 37, distribution accuracy of the EGR gas supplied to each of the cylinders of the in-line three-cylinder engine 110 including the cylinders of which the number is multiples of three may be maintained at a high level.

The EGR gas includes water (water vapor) discharged along with combustion of air-fuel mixture. The EGR gas is influenced by an outside air temperature and is cooled while the EGR gas is flowing through the upstream main pipe 31 and the two branched upstream branch pipes 32 and 33. In the first embodiment, even in a case where the water vapor is cooled to become condensed water along with cooling of the EGR gas, the EGR gas is equally distributed (by one-third each) to the three downstream distribution pipes 35 to 37. Thus, the condensed water may be restrained from being biased to flow to any specific downstream distribution pipes 35 to 37. Because the condensed water may be also equally distributed to the downstream distribution pipes 35 to 37, occurrence of misfire of a cylinder caused by intensive flow of the condensed water to the specific cylinder may be restrained. Because the distribution accuracy of the EGR gas (exhaust recirculation gas) supplied to each of the cylinders of the in-line three-cylinder engine 110 may be maintained at a high level, fuel consumption may easily increase with decrease of pumping loss (intake and exhaust loss) in the in-line three-cylinder engine 110. In addition, because the condensed water in addition to the EGR gas is equally distributed to the cylinders by one-third each, occurrence of misfire of a cylinder is restrained, which may easily inhibit decrease in quality of the engine.

In addition, in the first embodiment, the outlet 32*a* of the upstream branch pipe 32 is arranged between the inlet 35*a* of the third outside gas distribution pipe 35 and the inlet 36*a* of the downstream distribution pipe 36 relative to the collective pipe 34, the inlet 35*a* and the inlet 36*a* being next to each other. The outlet 33*a* of the upstream branch pipe 33 is arranged between the inlet 37*a* of the downstream distribution pipe 37 and the inlet 36*a* of the downstream distribution pipe 36 relative to the collective pipe 34, the inlet 37*a* and the inlet 36*a* being next to each other. Because the outlet 32*a* of the upstream branch pipe 32 is arranged between the inlet 35*a* and the inlet 36*a* next to each other while the outlet 33*a* of the upstream branch pipe 33 is arranged between the inlet 37*a* and the inlet 36*a* next to each other, the EGR gas may be uniformly and equally dispersed within the collective pipe 34. That is, the EGR gas concentration within the collective pipe 34 is uniform to thereby equally distribute the EGR gas within the collective pipe 34 to the three branched downstream distribution pipes 35 to 37.

In the first embodiment, the upstream branch pipes 32 and 33 are connected to the side wall portion 34*a* of the collective pipe 34 at the Z1 side extending along an arrangement direction of the cylinders 113 while the downstream distribution pipes 35 to 37 are connected to the side wall portion 34*b* of the collective pipe 34 at the Z2 side extending along the arrangement direction of the cylinders 113. Accordingly, the upstream branch pipes 32, 33 and the downstream distribution pipes 35 to 37 are arranged at opposite sides (at the Z1 side and at the Z2 side) from each other relative to the collective pipe 34. As a result, the EGR gas distribution portion 30 where the EGR gas is easily supplied to the collective pipe 34 and is easily redistributed to the downstream distribution pipes 35 to 37 from within the collective pipe 34 (the flow of the EGR gas is easily controlled) is obtainable.

In the first embodiment, the EGR gas distribution portion 30 is integrally provided at the intake apparatus body 80. Accordingly, weight saving of the intake apparatus body 80 because of the EGR gas distribution portion 30 integrally provided at the intake apparatus body 80 may be achieved.

In the first embodiment, the third piece 83 and the fourth piece 84 which are made of resin and which are divided beforehand are joined to each other to obtain the EGR gas distribution portion 30. Accordingly, by joining the divided resin-made third and fourth pieces 83 and 84 to each other, the intake apparatus 100 may be manufactured by easily adding to the intake apparatus body 80 the EGR gas distribution portion 30 including a complex flow structure that includes the single upstream main pipe 31, the two upstream branch pipes 32 and 33 branched from the upstream main pipe 31, the collective pipe 34 which gathers the EGR gas from the upstream branch pipes 32 and 33 and the three downstream distribution pipes 35 to 37 branched from the collective pipe 34.

Second Embodiment

Next, a second embodiment is explained with reference to FIGS. 2, 4 to 7. In the second embodiment, an example where a collective pipe 234 is configured by including an inner wall surface with ups and downs, which is different from the aforementioned first embodiment where the collective pipe 34 (see FIG. 2) is in a straight pipe form, is explained. The collective pipe 234 is as an example of the "outside gas collective passage" of the invention. In the drawings, components similar to the first embodiment bear the same reference numerals as the first embodiment.

Figure 4:
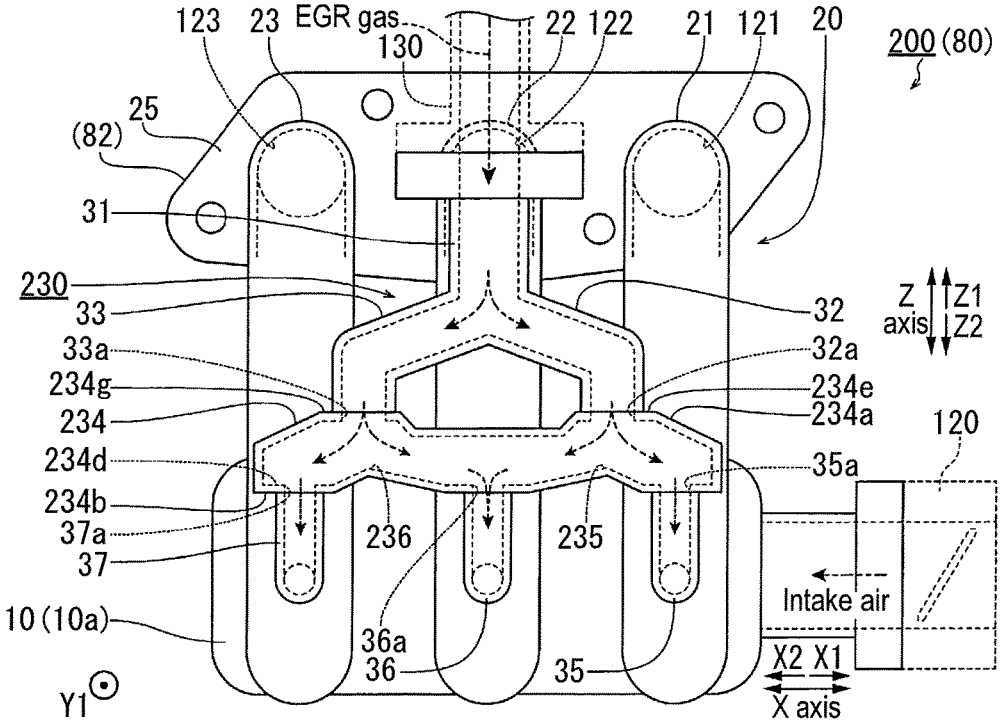
FIG. 4 is a diagram of the intake apparatus according to a second embodiment of the present invention as viewed from a lateral side of the in-line three-cylinder engine.

An intake apparatus 200 according to the second embodiment includes an EGR gas distribution portion 230 at an outer side portion of the intake apparatus body 80 as illustrated in FIG. 4. The EGR gas distribution portion 230 includes the upstream main pipe 31, the upstream branch pipes 32, 33, the collective pipe 234 and the downstream distribution pipes 35 to 37. In FIG. 4, a condition of an inner wall portion (internal flow passage) in the EGR gas distribution portion 230 is illustrated by broken lines. The EGR gas distribution portion 230 is as an example of the "outside gas distribution portion" of the invention.

Figure 5:
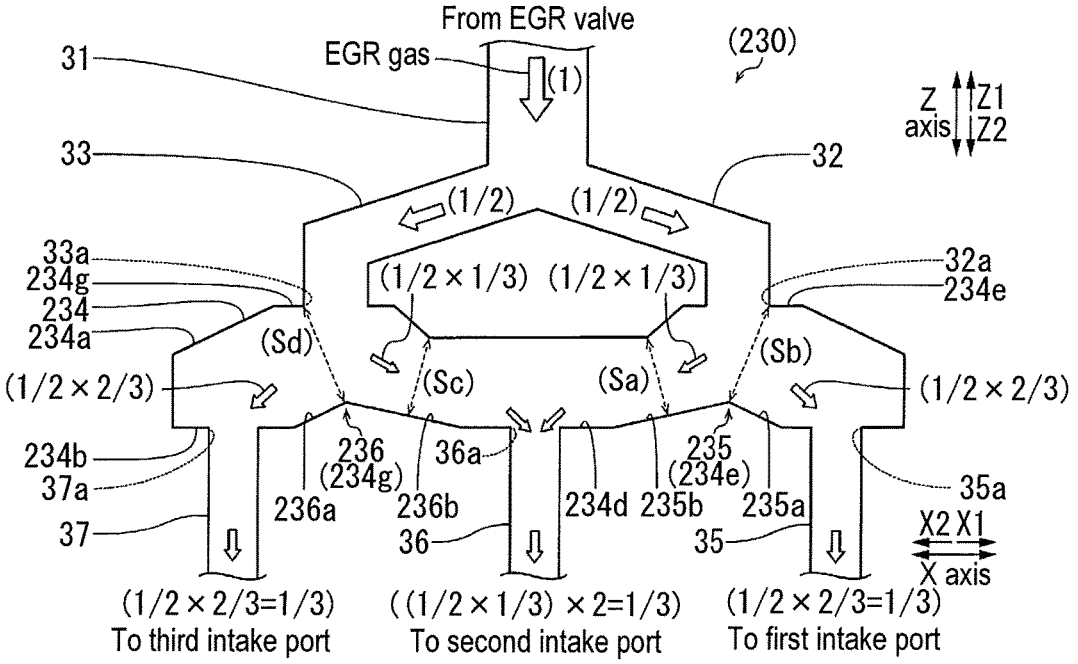
FIG. 5 is a schematic view of the flow passage construction of the EGR gas distribution portion provided at the intake apparatus according to the second embodiment of the present invention.

At this time, in the second embodiment, the collective pipe 234 substantially extends in the horizontal direction along the line of cylinders (X axis) as illustrated in FIGS. 4 and 5. On the other hand, each of a side wall portion 234*a* at the Z1 side (upper side) and a side wall portion 234*b* at the Z2 side (lower side) includes ups and downs in the up-down direction (axis Z direction). In a case where the collective pipe 234 is viewed from the lateral side of the engine along the arrow Y2 direction, the collective pipe 234 includes an outer configuration in an M-shape (or a reverse W-shape). The upstream branch pipes 32 and 33 are connected to top portions in the side wall portion 234*a* at the Z1 side (two portions at the X1 side and the X2 side). The downstream distribution pipes 35 to 37 are connected to bottom portions (three portions) in the side wall portion 234*b* at the Z2 side.

Figure 6:
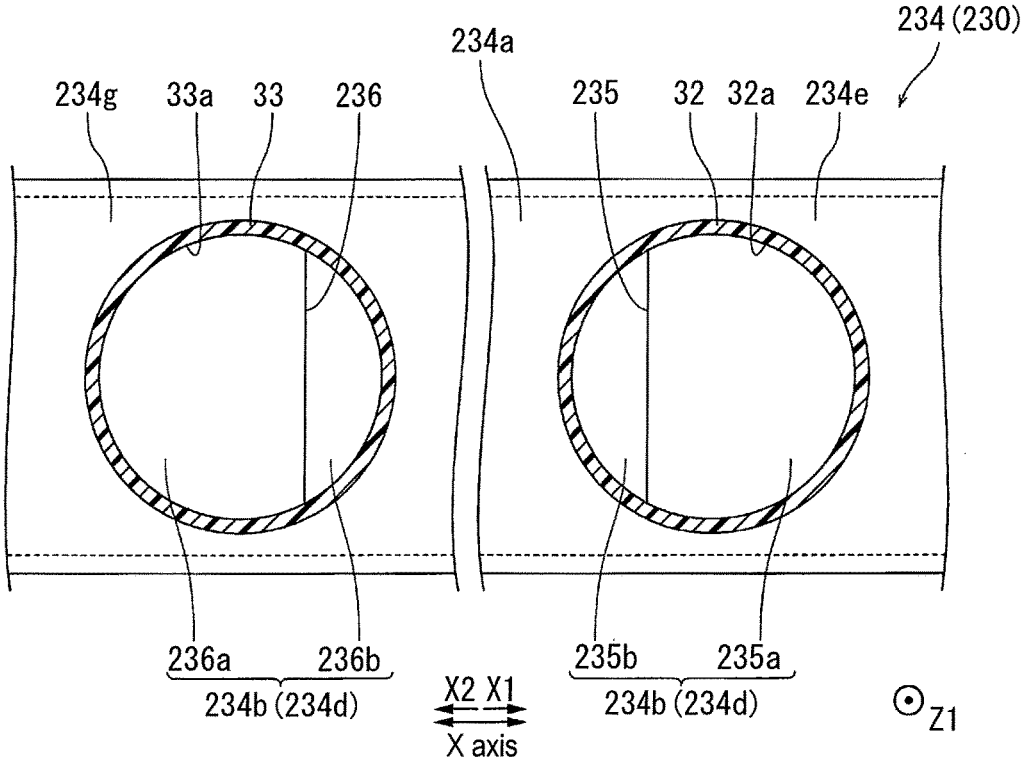
FIG. 6 is a diagram illustrating an inner configuration of a collective pipe at the EGR gas distribution portion provided at the intake apparatus according to the second embodiment of the present invention.

As illustrated in FIGS. 4 and 6, in the collective pipe 234, a protruding portion 235 is provided at a portion of an inner bottom surface 234*d* which is provided at a rear side (inner side) of the side wall portion 234*b*, the portion being provided in the gravitational direction (in the arrow Z2 direction) at a connection portion 234*e* of the collective pipe 234 relative to the upstream branch pipe 32. The protruding portion 235 protrudes towards the outlet 32*a* of the upstream branch pipe 32 relative to the collective pipe 234. The protruding portion 235 functions to distribute the EGR gas introduced from the outlet 32*a* to the outer side (X1 side) and the inner side (X2 side) relative to the outlet 32*a*. A protruding portion 236 is also provided at a portion of the inner bottom surface 234*d* of the collective pipe 234, the portion being provided in the gravitational direction (in the arrow Z2 direction) at a connection portion 234*g* of the collective pipe 234 relative to the upstream branch pipe 33. The protruding portion 236 protrudes towards the outlet 33*a* of the upstream branch pipe 33 relative to the collective pipe 234. The protruding portion 236 functions to distribute the EGR gas introduced from the outlet 33*a* to the outer side (X2 side) and the inner side (X1 side) relative to the outlet 33*a*.

In FIG. 6, an edge line of the protruding portion 235 is seen in a case where an inner portion of the collective pipe 234 is viewed from the outlet 32*a*. In addition, an edge line of the protruding portion 236 is seen in a case where an inner portion of the collective pipe 234 is viewed from the outlet 33*a*. The edge line of the protruding portion 235 is positioned to divide a cross-sectional area of the outlet 32*a* in approximately a ratio of 2 to 1. The edge line of the protruding portion 236 is positioned to divide a cross-sectional area of the outlet 33*a* in approximately a ratio of 2 to 1. An inclined surface 235*a* (at the X1 side) connects between the protruding portion 235 and the inlet 35*a* while an inclined surface 235*b* (at the X2 side) connects between the protruding portion 235 and the inlet 36*a*. An inclined surface 236*a* (at the X2 side) connects between the protruding portion 236 and the inlet 37*a* while an inclined surface 236*b* (at the X1 side) connects between the protruding portion 236 and the inlet 36*a*.

Accordingly, as illustrated in FIG. 4, other portions than the portions of the inner bottom surface 234*d* at the connection portions 234*e* and 234*g* are relatively dent downward (in the arrow Z2 direction). The inlets 35*a*, 36*a* and 37*a* of the downstream distribution pipes 35 to 37 relative to the collective pipe 234 are arranged at respective undermost portions in the inner bottom surface 234*d* of the collective pipe 234.

As illustrated in FIG. 5, according to the second embodiment, in the collective pipe 234, a minimum flow passage cross-sectional area Sa between the outlet 32*a* from the upstream branch pipe 32 to the collective pipe 234 and the inlet 36*a* positioned at the inner side than the outlet 32*a* among the three inlets 35*a* to 37*a* to the downstream distribution pipes 35 to 37 from the collective pipe 234 is smaller than a minimum flow passage cross-sectional area Sb between the outlet 32*a* and the inlet 35*a* positioned at the outer side (X1 side) than the outlet 32*a* among the three inlets 35*a* to 37*a* (Sa<Sb). In addition, a minimum flow passage cross-sectional area Sc between the outlet 33*a* from the upstream branch pipe 33 to the collective pipe 234 and the inlet 36*a* positioned at the inner side (X1 side) than the outlet 33*a* among the three inlets 35*a* to 37*a* is smaller than a minimum flow passage cross-sectional area Sd between the outlet 33*a* and the inlet 37*a* positioned at the outer side (X2 side) than the outlet 33*a* among the three inlets 35*a* to 37*a* (Sc<Sd).

Accordingly, a flow passage resistance from the outlet 32*a* (33*a*) of the upstream branch pipe 32 (33) for the collective pipe 234 to the inlet 36*a* positioned at the inner side (center side) than the outlet 32*a* (33*a*) among the three inlets 35*a* to 37*a* of the downstream distribution pipes 35 to 37 for the collective pipe 234 is configured to be greater than a flow passage resistance from the outlet 32*a* (33*a*) of the upstream branch pipe 32 (33) for the collective pipe 234 to the inlet 35*a* (37*a*) positioned at the outer side (X1 side and X2 side) than the outlet 32*a* (33*a*) among the three inlets 35*a* to 37*a* of the downstream distribution pipes 35 to 37 for the collective pipe 234. Accordingly, the EGR gas flowing from the upstream branch pipes 32 and 33 to the collective pipe 234 is inhibited from intensively flowing to the inlet 36*a* positioned at a center so that the flow rate to the inlet 36*a* is kept balanced with the flow rate to the inlet 35*a* and the flow rate to the inlet 37*a* at the outer side (X1 side and X2 side). That is, in a state where the EGR gas concentration within the collective pipe 234 is equalized and uniform, the EGR gas is equally suctioned to the downstream distribution pipes 35 to 37.

Figure 7:
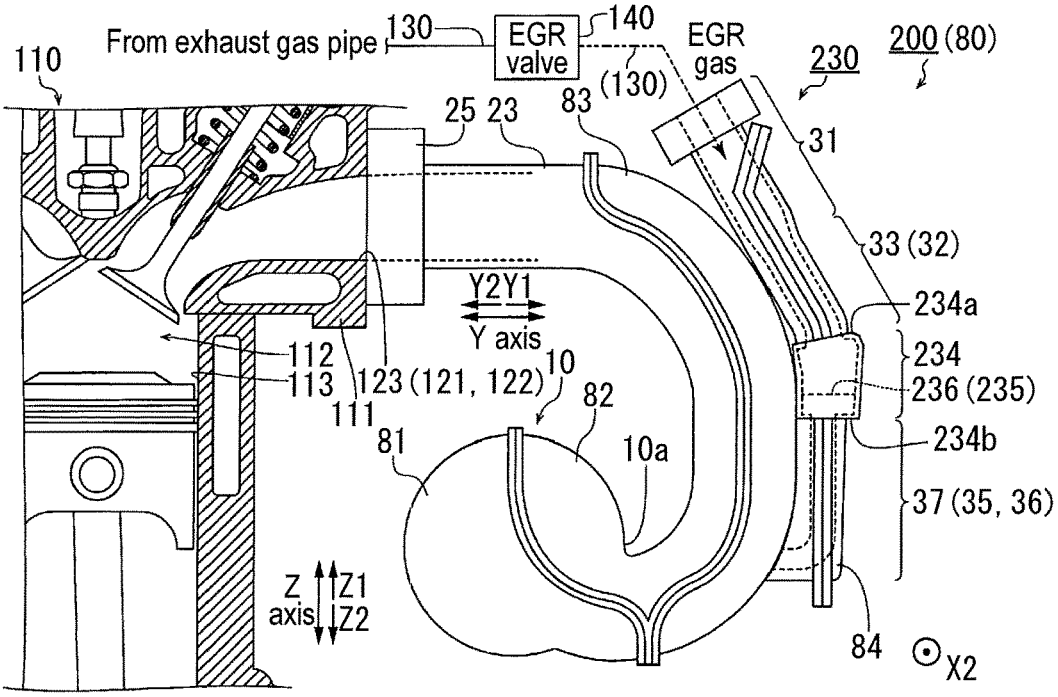
FIG. 7 is a side view of the intake apparatus according to the second embodiment of the present invention as viewed along the line of cylinders of the in-line three-cylinder engine.

In addition, as illustrated in FIG. 7, in a case where the intake apparatus 200 is viewed along the line of cylinders of the engine 110, the EGR gas distribution portion 230 extends in a state where the upstream main pipe 31 and the upstream branch pipes 32, 33 are inclined to the engine 110 by a predetermined angle relative to the axis Z direction. That is, an adjacent region of the outlet 32*a* (33*a*) of the upstream branch pipe 32 (33) is connected to the side wall portion 234*a* of the collective pipe 234 in a state being inclined by a predetermined angle relative to the horizontal plane (X-Y plane). The downstream distribution pipes 35 to 37 branched from the collective pipe 234 extend along the axis Z and gradually change directions at middle portions of the downstream distribution pipes 35 to 37 towards the arrow Y2 direction so as to be connected to the intake pipes 21 to 23 respectively. That is, the inlets 35*a* to 37*a* of the downstream distribution pipes 35 to 37 are connected to the side wall portion 234*b* of the collective pipe 234 at the Z2 side (lower side) on the horizontal plane (X-Y plane).

Even in a case where the EGR gas distribution portion 230 is bent at a portion of the collective pipe 234 along the up-down direction, the protruding portion 235 is provided at the portion of the inner bottom surface 234*d* in the gravitational direction (the arrow Z2 direction) at the connection portion 234*e* while the protruding portion 236 is provided at the portion of the inner bottom surface 234*d* in the gravitational direction (the arrow Z2 direction) at the connection portion 234*g*. Therefore, even in a case where the EGR gas flows out from the outlet 32*a* (33*a*) into the collective pipe 234 in a direction being inclined to the gravitational direction, the EGR gas is securely divided into two directions by the protruding portion 235 (236) provided at the portion in the inner bottom surface 234*d* in the gravitational direction. At this time, each of the connection portions 234*e* and 234*g* includes the outlet 32*a* (33*a*) and surroundings thereof and corresponds to a cross-sectional portion at the aforementioned region of the collective pipe 234. Thus, the connection portion 234*e* (234*g*) includes a portion of the inner bottom surface 234*d*.

Even in a case where the water vapor contained in the EGR gas is cooled to become the condensed water while the EGR gas flows through the upstream main pipe 31 and the upstream branch pipes 32, 33, the condensed water flows down to the (three) undermost portions in the inner bottom surface 234*d* along the protruding portion 235 (236) towards the inclined surfaces 235*a* and 235*b* (236*a* and 236*b*) within the collective pipe 234. The condensed water is then led to each of the inlets 35*a* to 37*a* of the three downstream distribution pipes 35 to 37. Accordingly, the condensed water is configured to be securely and evenly discharged (by one-third each) to the downstream distribution pipes 35 to 37 via the inlets 35*a* to 37*a* arranged at the undermost portions in the inner bottom surface 234*d* of the collective pipe 234. The other construction of the intake apparatus 200 is similar to the first embodiment.

Effects of the Second Embodiment

The second embodiment achieves the following effects.

As mentioned above, in the collective pipe 234 of the second embodiment, the minimum flow passage cross-sectional area Sa between the outlet 32*a* from the upstream branch pipe 32 to the collective pipe 234 and the inlet 36*a* of the downstream distribution pipe 36 positioned at the inner side (X2 side) than the outlet 32*a* is specified to be smaller than the minimum flow passage cross-sectional area Sb between the outlet 32*a* and the inlet 35*a* positioned at the outer side (X1 side) than the outlet 32*a*. In addition, the minimum flow passage cross-sectional area Sc between the outlet 33*a* from the upstream branch pipe 33 to the collective pipe 234 and the inlet 36*a* of the downstream distribution pipe 36 positioned at the inner side (X1 side) than the outlet 33*a* is specified to be smaller than the minimum flow passage cross-sectional area Sd between the outlet 33*a* and the inlet 37*a* positioned at the outer side (X2 side) than the outlet 33*a*. Accordingly, the flow passage resistance from the outlet 32*a* (33*a*) of the upstream branch pipe 32 (33) for the collective pipe 234 to the inlet 36*a* positioned at the inner side (center side) than the outlet 32*a* (33*a*) among the three inlets 35*a* to 37*a* of the downstream distribution pipes 35 to 37 for the collective pipe 234 may be greater than the flow passage resistance from the outlet 32*a* (33*a*) of the upstream branch pipe 32 (33) for the collective pipe 234 to the inlet 35*a* (37*a*) positioned at the outer side (X1 side and X2 side) than the outlet 32*a* (33*a*) among the three inlets 35*a* to 37*a* of the downstream distribution pipes 35 to 37 for the collective pipe 234.

Accordingly, the flow rate of the EGR gas flowing to the inlet 36*a* positioned at the center among the three inlets 35*a* to 37*a* of the downstream distribution pipes 35 to 37 for the collective pipe 234, the EGR gas flowing from the upstream branch pipe 32 (33) to the collective pipe 234, may be relatively smaller than the flow rate of the EGR gas flowing to the inlet 35*a* (37*a*) positioned at the outer side (at the X1 side and the X2 side) than the inlet 36*a*. The flow rate (total flow rate) of the gas flowing to the inlet 36*a* of the downstream distribution pipe 36 positioned at the center as viewed from the two upstream branch pipes 32 and 33 may come closer to a state being equal to the flow rate of the gas flowing to the inlet 35*a* (37*a*) of the third outside gas distribution pipe 35 (37) positioned at each outer side (each of the X1 side and the X2 side) as viewed from the two upstream branch pipes 32 and 33. As a result, the EGR gas within the collective pipe 234 is securely and equally distributable, by one-third each, to the three branched downstream distribution pipes 35 to 37.

In addition, according to the second embodiment, the protruding portion 235 is provided at the portion of the inner bottom surface 234*d* of the collective pipe 234, the portion being provided in the gravitational direction (in the arrow Z2 direction) at the connection portion 234*e* of the upstream branch pipe 32. The protruding portion 235 protrudes towards the outlet 32*a* of the upstream branch pipe 32 relative to the collective pipe 234 so as to distribute the EGR gas introduced from the outlet 32*a* to the outer side (X1 side) and the inner side (X2 side) than the outlet 32*a*. The protruding portion 236 is also provided at the portion of the inner bottom surface 234*d* of the collective pipe 234, the portion being provided in the gravitational direction (in the arrow Z2 direction) at the connection portion 234*g* of the upstream branch pipe 33. The protruding portion 236 protrudes towards the outlet 33*a* of the upstream branch pipe 33 relative to the collective pipe 234 so as to distribute the EGR gas introduced from the outlet 33*a* to the outer side (X2 side) and the inner side (X1 side) than the outlet 33*a*. Then, the inlets 35*a* to 37*a* to the downstream distribution pipes 35 to 37 from the collective pipe 234 are configured to be arranged at the respective undermost portions in the inner bottom surface 234*d* of the collective pipe 234.

Even in a case where the water vapor is cooled to become the condensed water while the EGR gas flows through the upstream main pipe 31 and the upstream branch pipes 32, 33, the condensed water which flows down by the protruding portion 235 (236) may be easily led to the inlets 35*a* to 37*a* of the three downstream distribution pipes 35 to 37 from the collective pipe 34. Because the inlets 35*a* to 37*a* of the three downstream distribution pipes 35 to 37 are arranged in the vicinity of the undermost portions in the inner bottom surface 234*d* of the collective pipe 234, the condensed water is securely discharged to the downstream distribution pipes 35 to 37 via the inlets 35*a* to 37*a* arranged in the vicinity of the undermost portions. The condensed water is inhibited from being greatly accumulated at the collective pipe 234. The other effects of the second embodiment are similar to the first embodiment.

Modified Example of the Second Embodiment

Next, a modified example of the second embodiment is explained with reference to FIGS. 2 and 8. In the modified example of the second embodiment, an example where a collective pipe 334 is configured by including ribs 335 and 336 at an inner wall surface (ceiling surface 334*c*), which is different from the aforementioned second embodiment where the collective pipe 234 is configured by including the inclined inner wall surface (inner bottom surface 234*d*), is explained. The collective pipe 334 is as an example of the "outside gas collective passage" of the invention. In the drawings, components similar to the first embodiment bear the same reference numerals as the first embodiment.

Figure 8:
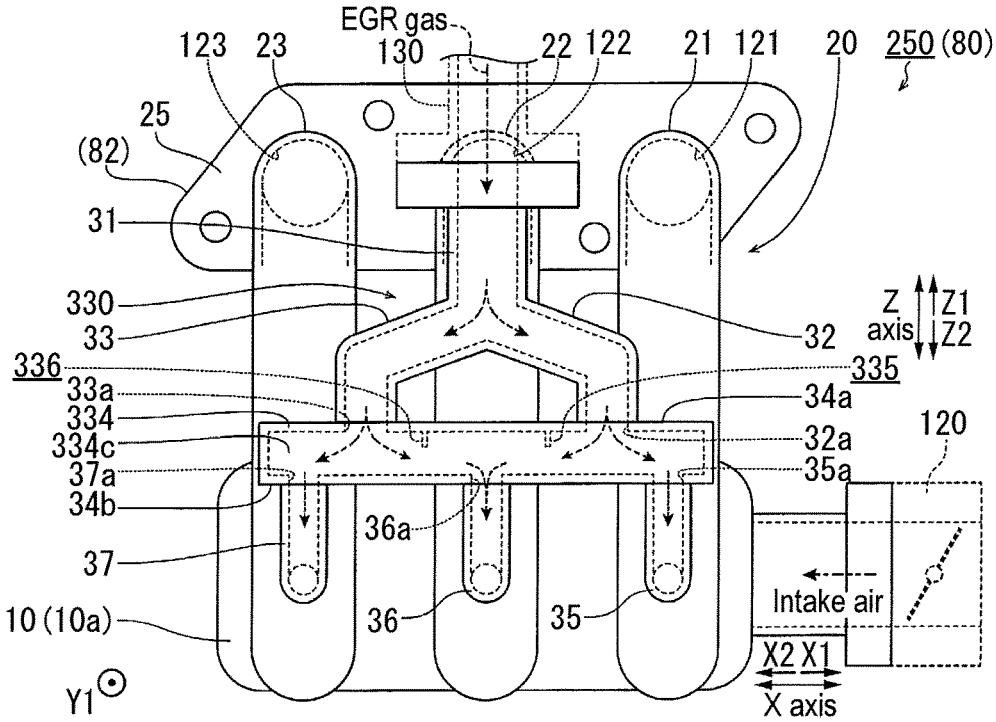
FIG. 8 is a diagram of the intake apparatus according to a modified example of the second embodiment of the present invention as viewed from a lateral side of the in-line three-cylinder engine.

According to an intake apparatus 250 according to the modified example of the second embodiment, an EGR gas distribution portion 330 is provided at the outer side portion of the intake apparatus body 80 as illustrated in FIG. 8. The EGR gas distribution portion 330 includes the upstream main pipe 31, the upstream branch pipes 32, 33, the collective pipe 34 and the downstream distribution pipes 35 to 37. The EGR gas distribution portion 30 extends in a straight pipe form along the line of cylinders (X axis) in the same way as the collective pipe 34 (see FIG. 2) according to the first embodiment. The EGR gas distribution portion 330 is as an example of the "outside gas distribution portion" of the invention.

In the modified example of the second embodiment, the rib 335 (illustrated by broken lines) which extends downward is provided at a portion between the outlet 32*a* and the inlet 36*a* in the ceiling surface 334*c* of the collective pipe 334. The rib 336 (illustrated by broken lines) which extends downward is provided at a portion between the outlet 33*a* and the inlet 36*a* in the ceiling surface 334*c* of the collective pipe 334. Accordingly, the minimum flow passage cross-sectional area between the outlet 32*a* and the inlet 36*a* is smaller than the minimum flow passage cross-sectional area between the outlet 32*a* and the inlet 35*a*. The minimum flow passage cross-sectional area between the outlet 33*a* and the inlet 36*a* is also smaller than the minimum flow passage cross-sectional area between the outlet 33*a* and the inlet 37*a*.

Accordingly, each of the flow passage resistance between the outlet 32*a* and the inlet 36*a* and the flow passage resistance between the outlet 32*a* and the inlet 36*a* is smaller than each of the flow passage resistance between the outlet 32*a* and the inlet 35*a* and the flow passage resistance between the outlet 33*a* and the inlet 37*a*. The other construction of the intake apparatus 250 is similar to the first embodiment.

Effects of the Modified Example of the Second Embodiment

According to the modified example of the second embodiment, the rib 335 which extends downward is provided between the outlet 32*a* and the inlet 36*a* while the rib 336 which extends downward is provided between the outlet 33*a* and the inlet 36*a* in the ceiling surface 334*c* of the collective pipe 334. Thus, the minimum flow passage cross-sectional area between the outlet 32*a* and the inlet 36*a* and the minimum flow passage cross-sectional area between the outlet 33*a* and the inlet 36*a* are configured to be smaller than the minimum flow passage cross-sectional area between the outlet 32*a* and the inlet 35*a* and the minimum flow passage cross-sectional area between the outlet 33*a* and the inlet 37*a* respectively. As a result, in the EGR gas distribution portion 330 in the same way as the second embodiment, the flow passage resistance is differentiated in the collective pipe 334 so that the EGR gas may be securely and evenly distributed, by one-third each, to the three branched downstream distribution pipes 35 to 37. The other effects of the modified example of the second embodiment are similar to the first embodiment.

Modified Example

The embodiments disclosed here are considered as examples at any point and not to be restrictive. The scope of the invention is represented not by the explanations of the aforementioned embodiments but by the scope of claims. The scope of the invention further includes any modification (modified examples) within the meaning and scope equivalent to the scope of claims.

For example, according to the aforementioned first and second embodiments and the modified example thereof, the example where the single upstream main pipe 31 is branched into two so that the two upstream branch pipes 32 and 33 are connected to the collective pipe 34 (234, 334) is explained, however, the invention is not limited thereto. For example, the "outside gas distribution portion" may be configured in a manner that the "first outside gas distribution pipe" of the invention is branched into four so that the four "second outside gas distribution pipes" are connected to the "outside gas collective passage".

Figure 9:
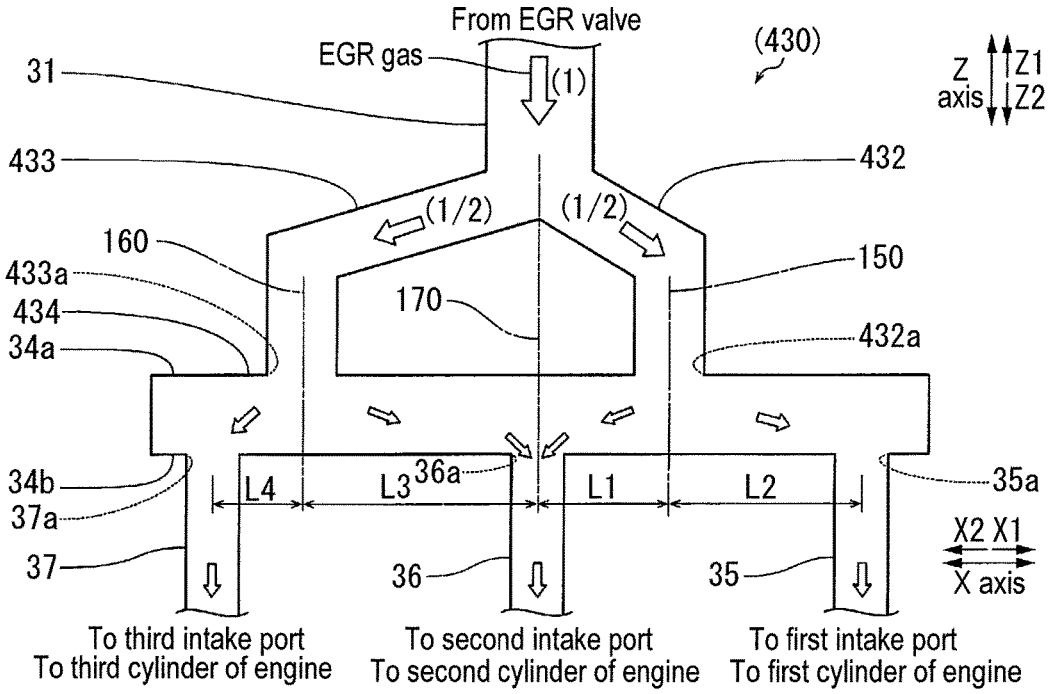
FIG. 9 is a schematic view of the flow passage construction of the EGR gas distribution portion provided at the intake apparatus according to a modified example of the present invention.

In addition, according to the aforementioned first and second embodiments and the modified example thereof, the example where the positions of the inlets 35*a* and 36*a* relative to the outlet 32*a* are adjusted so that L1:L2=2:1 is obtained while the positions of the inlets 37*a* and 36*a* relative to the outlet 33*a* are adjusted so that L3:L4=2:1 is obtained (L1=L3) is explained, however, the invention is not limited thereto. For example, an EGR gas distribution portion 430 may be constructed as a modified example as illustrated in FIG. 9 with the position of the outlet 32*a* between the inlets 35*a* and 36*a* and the position of the outlet 33*a* between the inlets 37*a* and 36*a*. The EGR gas distribution portion 430 is an example of the "outside gas distribution portion" of the invention.

Specifically, as illustrated in FIG. 9, in the EGR gas distribution portion 430, two upstream branch pipes 432 and 433 branched from the upstream main pipe 31 exhibit a left-right asymmetry relative to the axis Z (an alternate long and short dash line 170). That is, an outlet 432*a* of the upstream branch pipe 432 (at a position of the alternate long and short dash line 150) is arranged at a position closer to the inlet 36*a* at the center while an outlet 433*a* of the upstream branch pipe 433 (at a position of the alternate long and short dash line 160) is arranged at a position closer to the inlet 37*a* at the X2 side (L1<L3). Each of the upstream branch pipes 432 and 433 is as an example of the "second outside gas distribution pipe" of the invention.

In a case where cylinder explosion occurs in order from the third cylinder (at the X2 side), the second cylinder (at a center) and the first cylinder (at the X1 side) in the in-line three-cylinder engine 110, the EGR gas concentration in the vicinity of the inlet 37*a* instantaneously increases within the collective pipe 434 when a piston of the third cylinder moves downward so that the EGR gas together with the intake air is suctioned via the downstream distribution pipe 37. Next, when the EGR gas is suctioned via the downstream distribution pipe 36 along with downward movement of a piston of the second cylinder, the EGR gas concentration in the vicinity of the inlet 36*a* instantaneously increases. Finally, when the EGR gas is suctioned via the downstream distribution pipe 35 along with downward movement of a piston of the first cylinder, the EGR gas concentration in the vicinity of the inlet 35*a* instantaneously increases. Nevertheless, in fact, the high-concentrated EGR gas in the vicinity of the inlet 37*a* is suctioned mainly via the inlet 36*a* when the piston of the second cylinder moves downward and the high-concentrated EGR gas in the vicinity of the inlet 36*a* is mainly suctioned via the inlet 35*a* when the piston of the third cylinder moves downward. On the other hand, the high-concentrated EGR gas in the vicinity of the inlet 35*a* is unlikely to be suctioned via the inlet 37*a* even when the piston of the first cylinder moves downward because the collective pipe 434 forms a horizontally long configuration so that the inlet 37*a* is positioned away from the inlet 35*a*.

Thus, in order to make the high-concentrated EGR gas to be easily suctioned via the inlet 37*a* when the piston of the first cylinder moves downward, the outlet 433*a* is disposed closer to the inlet 37*a* and the outlet 432*a* is disposed closer to the center inlet 36*a* so that the outlet 432*a* is away from the inlet 35*a* in the X2 direction. Accordingly, the EGR gas concentration in the vicinity of the inlet 37*a* relatively increases to the EGR gas concentration at the inlet 35*a* or the inlet 36*a* while the average EGR gas concentration within the collective pipe 434 is equalized with the two upstream branch pipes 432 and 433. Then, instantaneous imbalance of the EGR gas concentration resulting from the order of cylinder explosion may be eliminated. In a case where the cylinder explosion occurs in order from the first cylinder, the second cylinder and the third cylinder, an EGR gas distribution portion including a left and right opposite configuration from the EGR gas distribution portion 430 is applicable. Accordingly, connection positions of the upstream branch pipes 432 and 433 to the collective pipe 434 are appropriately adjusted (tuned) to improve further distribution accuracy of the outside gas supplied to each cylinder of the internal combustion engine.

According to the first and second embodiments and the modified example thereof, the example where the position of the outlet 32*a* between the inlets 35*a* and 36*a* and the position of the outlet 33*a* between the inlets 37*a* and 36*a* are adjusted is explained, however, the invention is not limited thereto. As long as the EGR gas concentration within the collective pipe 34 (234, 334) is uniform and equalized, not only the positions of the outlets 32*a* and 33*a* is adjusted but also the plural "second outside gas distribution pipes" of the invention may be configured to be connected to the collective pipe 34 (234, 334) in a state where a pipe diameter and a pipe length of each of the plural "second outside gas distribution pipes" of the invention may be differentiated from one another.

In the second embodiment, the example where the inlets 35*a* to 37*a* of the downstream distribution pipes 35 to 37 relative to the collective pipe 234 are arranged at the undermost portions in the inner bottom surface 234*d* of the collective pipe 234 is explained, however, the invention is not limited thereto. As long as the inlets 35*a* to 37 are arranged at positions at which the condensed water contained in the EGR gas is dischargeable, the inlets 35*a* to 37*a* may be configured to be arranged at the undermost portions and vicinity thereof in the inner bottom surface 234*d*.

In the first and second embodiments and the modified example thereof, the example where the intake apparatus body 80 and the EGR gas distribution portion 30 (230, 330) are both made of resin (polyamide resin) is explained, however, the invention is not limited thereto. As long as the EGR gas distribution portion 30 (230, 330) is provided as a separate member (separate component) from the intake apparatus body 80 at an inner portion of the intake apparatus body 80, the intake apparatus body 80 and the EGR gas distribution portion 30 (230, 330) may be made of metal.

In the first and second embodiments and the modified example thereof, the example where the present invention is applied to the EGR gas distribution portion 30 (230, 330) which distributes the EGR gas (exhaust recirculation gas) to each of the cylinders of the in-line three-cylinder engine 110 is explained, however, the invention is not limited thereto. For example, it is possible to apply the present invention to the "outside gas distribution portion" distributing to each of the cylinders of the in-line three-cylinder engine 110 blow-by gas (PCV (Positive Crankcase Ventilation) gas) which aims to ventilate inside a crank chamber as the "outside gas" of the invention.

In the first and second embodiments and the modified example thereof, the example where the present invention is applied to the intake apparatus 100 (200, 250) connected to the in-line three-cylinder engine 110 is explained, however, the invention is not limited thereto. For example, as the internal combustion engine including cylinders of which the number is multiples of three, the present invention is applicable to an intake apparatus for a V6 cylinder engine where three cylinders are opposed to one another or for a V12 cylinder engine where the V6 cylinder engines are arranged in series. In a case of the V6 cylinder engine, two of the EGR gas distribution portions 30 for the three cylinders at one side and the three cylinders at the other side are utilized. That is, a single EGR pipe connected to a downstream of the EGR valve 140 (see FIG. 1) may be configured to be branched into two pipes which are then connected to the respective upstream main pipes 31 of the EGR gas distribution portions 30. In a case of the V12 cylinder engine, four of the EGR gas distribution portions 30 each of which is provided for three cylinders are utilized. That is, a single EGR pipe at the downstream of the EGR valve 140 is branched into two pipes each of which is further branched into two pipes to be connected to the upstream main pipes 31 of the EGR gas distribution portions 30.

In the first and second embodiments and the modified example thereof, the example where the present invention is applied to the intake apparatus for the in-line three-cylinder engine 110 serving as a gasoline engine is explained, however, the invention is not limited thereto. The present invention is applicable to the intake apparatus of a diesel engine or a gas engine, for example, as the internal combustion engine.

In the first and second embodiments and the modified example thereof, the example where the "intake apparatus" of the invention is applied to the in-line three-cylinder engine 110 for an automobile is explained, however, the invention is not limited thereto. The intake apparatus of the invention is applicable to other internal combustion engines than the engine for an automobile. In addition, the present invention is applicable to the intake apparatus mounted at not only an engine (internal combustion engine) that is mounted at an ordinary vehicle (automobile) but also an internal combustion engine that is mounted at transportation equipment such as a train and a vessel, for example, and further an internal combustion engine installed at facility equipment in a stationary type other than the transportation equipment.

EXPLANATION OF REFERENCE NUMERALS

10 surge tank
20 intake pipe portion
21, 22, 23 intake pipe
30, 230, 330, 430 EGR gas distribution portion (outside gas distribution portion)
31 upstream main pipe (first outside gas distribution pipe)
32, 33, 432, 433 upstream branch pipe (second outside gas distribution pipe)
32*a*, 33*a*, 432*a*, 433*a* outlet
34, 234, 334, 434 collective pipe (outside gas collective passage)
34*a*, 234*a* side wall portion (one-side wall portion)
34*b*, 234*b* side wall portion (other-side wall portion)
35, 36, 37 downstream distribution pipe (third outside gas distribution pipe)
35*a*, 36*a*, 37*a* inlet
80 intake apparatus body
81 first piece
82 second piece

83 third piece
84 fourth piece
100, 200, 250 intake apparatus
110 in-line three-cylinder engine (internal combustion engine)
130 EGR gas pipe (outside gas supply source)
140 EGR valve
234*d* inner bottom surface
234*e*, 234*g* connection portion
235, 236 protruding portion
334*d* ceiling surface
335, 336 rib

The invention claimed is:

1. An intake apparatus for an internal combustion engine, comprising:

an intake apparatus body including a plurality of intake pipes which are connected to an intake air supply source at respective intake air connections and to respective cylinders of the internal combustion engine, the internal combustion engine including the cylinders of which the number is multiples of three; and an outside gas distribution portion configured to distribute outside gas to each of the plurality of intake pipes, the outside gas distribution portion including:

a single first outside gas distribution pipe connected to an outside gas supply source;

a plurality of second outside gas distribution pipes branched from the first outside gas distribution pipe;

an outside gas collective passage gathering outside gas from the plurality of second outside gas distribution pipes; and three third outside gas distribution pipes branched from the outside gas collective passage and connected to the plurality of intake pipes respectively at connections different from the intake air connections.

2. The intake apparatus for the internal combustion engine according to claim 1, wherein the plurality of second outside gas distribution pipes includes two second outside gas distribution pipes, an outlet of each of the second outside gas distribution pipes relative to the outside gas collective passage is arranged between two inlets of the third outside gas distribution pipes relative to the outside gas collective passage, the two inlets being next to each other.

3. The intake apparatus for the internal combustion engine according to claim 2, wherein in the outside gas collective passage, a minimum flow passage cross-sectional area between the outlet of each of the second outside gas distribution pipes relative to the outside gas collective passage and an inlet positioned at an inner side than the outlet among three inlets of the third outside gas distribution pipes relative to the outside gas collective passage is smaller than a minimum flow passage cross-sectional area between the outlet and the inlet positioned at an outer side than the outlet among the three inlets.

4. The intake apparatus for the internal combustion engine according to claim 1, wherein a protruding portion is provided at a portion of an inner bottom surface of the outside gas collective passage in a gravitational direction at a connection portion of the outside gas collective passage relative to each of the second outside gas distribution pipes, the protruding portion protruding towards the outlet of each of the second outside gas distribution pipes relative to the outside gas collective passage and distributing outside gas which is introduced from the outlet to an outer side and an inner side than the outlet, each of the inlets of the third outside gas distribution pipes relative to the outside gas collective passage is arranged at an undermost portion in the inner bottom surface of the outside gas collective passage.

5. The intake apparatus for the internal combustion engine according to claim 1, wherein the outside gas is exhaust recirculation gas for recirculating a portion of exhaust gas emitted from the internal combustion engine.

6. The intake apparatus for the internal combustion engine according to claim 1, wherein the plurality of second outside gas distribution pipes are connected to a wall portion at one side of the outside gas collective passage which extends along a line of the cylinders of the internal combustion engine, the three third outside gas distribution pipes are connected to a wall portion at the other side of the outside gas collective passage which extends along the line of the cylinders of the internal combustion engine.

7. The intake apparatus for the internal combustion engine according to claim 1, wherein the outside gas distribution portion is integrally provided at the intake apparatus body.

8. The intake apparatus for the internal combustion engine according to claim 1, wherein the outside gas distribution portion is obtained by a plurality of divided resin members which are joined to one another.

* * * * *